United States Patent [19]

Kreager et al.

[11] Patent Number: 4,726,171

[45] Date of Patent: Feb. 23, 1988

[54] METHOD AND APPARATUS FOR APPLYING ARTICLE TO INSIDE OF BAG

[75] Inventors: William D. Kreager, Dallas; Stephen R. Holten, Plano; Stephen M. Callahan, Lewisville; Kenneth R. Berger, Grapevine, all of Tex.

[73] Assignee: Frito-Lay, Inc., Dallas, Tex.

[21] Appl. No.: 906,722

[22] Filed: Sep. 12, 1986

[51] Int. Cl.[4] ..... B65B 11/58

[52] U.S. Cl. ..... 53/410; 53/451; 53/474; 53/170; 53/238; 53/552; 53/449; 53/128

[58] Field of Search ..... 53/128, 415, 137, 416, 53/449, 170, 451, 410, 551, 238, 474, 552; 493/188, 210, 302, 220, 944, 222, 961, 223, 224

[56] References Cited

U.S. PATENT DOCUMENTS

| | | | |
|---|---|---|---|
| 1,541,167 | 6/1925 | Mulvey . | |
| 2,259,866 | 10/1941 | Stokes | 53/156 X |
| 2,260,064 | 10/1941 | Stokes | 53/449 X |
| 2,294,220 | 8/1942 | Albertson | 53/128 X |
| 2,815,620 | 12/1957 | Prodigo . | |
| 3,381,442 | 5/1968 | Paxton . | |
| 3,611,883 | 10/1971 | Grob | 493/223 X |
| 3,680,445 | 8/1972 | Pearl et al. | 493/223 |
| 3,919,038 | 11/1975 | Davis | 156/511 |
| 3,940,905 | 3/1976 | Perry | 53/415 X |
| 3,960,646 | 6/1976 | Wiedamann | 156/518 |
| 4,083,737 | 4/1978 | Foote, Jr. et al. | 156/73.1 |
| 4,182,222 | 1/1980 | Stahl | 493/224 X |
| 4,337,058 | 6/1982 | Lerner | 493/210 X |
| 4,455,810 | 6/1984 | Kreager et al. | 53/451 |
| 4,537,586 | 8/1985 | Gale et al. | 493/220 |
| 4,545,781 | 10/1985 | Carl et al. | 493/220 |
| 4,555,289 | 11/1985 | Kreager | 156/203 |
| 4,642,085 | 2/1987 | Helm | 493/223 X |

OTHER PUBLICATIONS

1984 New Jersey Machine brochure.
Undated Longford Equipment International brochure.
Undated Thiele brochure, 1984 GEMCO brochure.
Undated Austin-Gordon Design brochure Undated MGS

*Primary Examiner*—Robert L. Spruill
*Assistant Examiner*—Steven P. Weihrouch
*Attorney, Agent, or Firm*—Bernard, Rothwell & Brown

[57] ABSTRACT

A bag having an article applied to an inside surface thereof is formed in a continuous bag-making operation by conveying a bag-making film web and a continuous strip of material in joinable proximity with each other. The article is formed by severing the strip of material and at least one edge portion of the severed article is bonded to the continuous web of bag film. The longitudinal margins of the web are then brought together and bonded to form a tube with the article bonded to the inner surface of the tube, and bags are formed and severed from the tube with the article bonded to one inner surface of the bag.

30 Claims, 8 Drawing Figures

METHOD AND APPARATUS FOR APPLYING ARTICLE TO INSIDE OF BAG

BACKGROUND OF THE INVENTION

1. Field of the Invention

The present invention relates generally to providing articles such as coupons, premiums, and the like with products packaged in containers such as bags.

2. Description of the Background Art

It has long been recognized as desirable to be able to provide articles, such as coupons, premiums, and the like, with commercially sold products packaged in containers such as bags.

The simplest method for providing a coupon with a packaged product such as a bag of potato chips is to print the coupon directly on the bag as part of the label. However, the inconvenience of tearing or cutting the bag to separate the coupon is apparent, as is the unsuitability of this method for providing individually packaged premiums such as condiments.

Prior art methods for placing coupons and like articles inside of bags include gravity-fed "pick-and-place" devices which, as the name implies, place individual articles into a bag before, during or after introduction of product into the bag. Articles placed into bags by "pick-and-place" machines generally reside freely within the bag, i.e., are not connected to the bag. The articles are therefore free to move around within the bag to positions which may be less than optimally located for maximum visibility by the consumer. Furthermore, with high speed packaging devices such as form-and-fill baggers for snack foods, pick-and-place machines may possess disadvantages such as slow operating speed, as well as inconsistent and unpredictable article placement.

U.S. Pat. Nos. 1,541,167, 2,815,620 and 4,545,781 disclose various devices and methods for applying coupons, premiums, samples and the like to the outside of bags. One disadvantage of attaching a coupon, premium, or sample to the outside of a bag is that persons have access to the article without the necessity of opening the bag.

U.S. Pat. No. 4,537,586 discloses a method and apparatus for applying a continuous strip of coupons to a continuous web of bag paper prior to forming the web of bag paper into a four-sided self-opening paper grocery bag with the coupon strip applied to the inside front panel thereof. This arrangement does not appear desirable for use with sealed bags of products such as snack food because the arrangement apparently requires a special form of bag, i.e., an open top, four-sided self-opening paper grocery bag.

Accordingly, there remains a need for an inexpensive and convenient way to apply articles such as prepackaged premiums and coupons to the inside of sealed bags of product in a manner such that the articles retains maximum and optimal customer visibility and availability upon bag opening without loss of intended functional properties of the carrier bag.

SUMMARY OF THE INVENTION

In accordance with the present invention, a bag having length and width dimensions and an article applied to an inside surface thereof is formed by conveying a continuous web of bag-making film in a longitudinal direction thereof and providing a continuous strip of material in joinable proximity with the web, the strip may have a width less than one-half, but preferentially is sized less than one-quarter, of the transverse width of the web. The strip of material is severed to form an article with a length dimension less than one-half the length dimension of the bag, and at least one edge portion of the severed article is bonded to the continuous web of bag film. Longitudinal margins of the web of bag film are brought together and bonded to form the web into a tube having an inner surface to which the article is bonded. A bag is formed and severed from the tube with the article bonded to one inner surface of the bag along at least one edge portion of the article.

DESCRIPTION OF THE PREFERRED EMBODIMENTS

Figure 2:
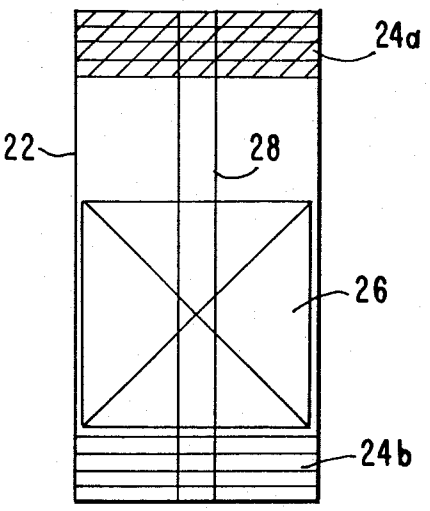
FIG. 2 is an elevational view of a separate coupon packet for application to a bag according to the invention.

The invention can be described with reference to preferred embodiments illustrated schematically in the drawings. According to one aspect, the invention will be described in the environment of a form-and-fill bagging machine utilizing a continuous web of packaging material or film which is moved intermittently and formed into a package while product is packed therein before the package is sealed. For a general description of formand-fill packaging machines, see expired U.S. Pat. No. 2,899,875. The invention is equally applicable to continuous motion horizontal packaging by sequentially forming a continuous web into bags around horizontally advancing product or trays of product.

Figure 1:
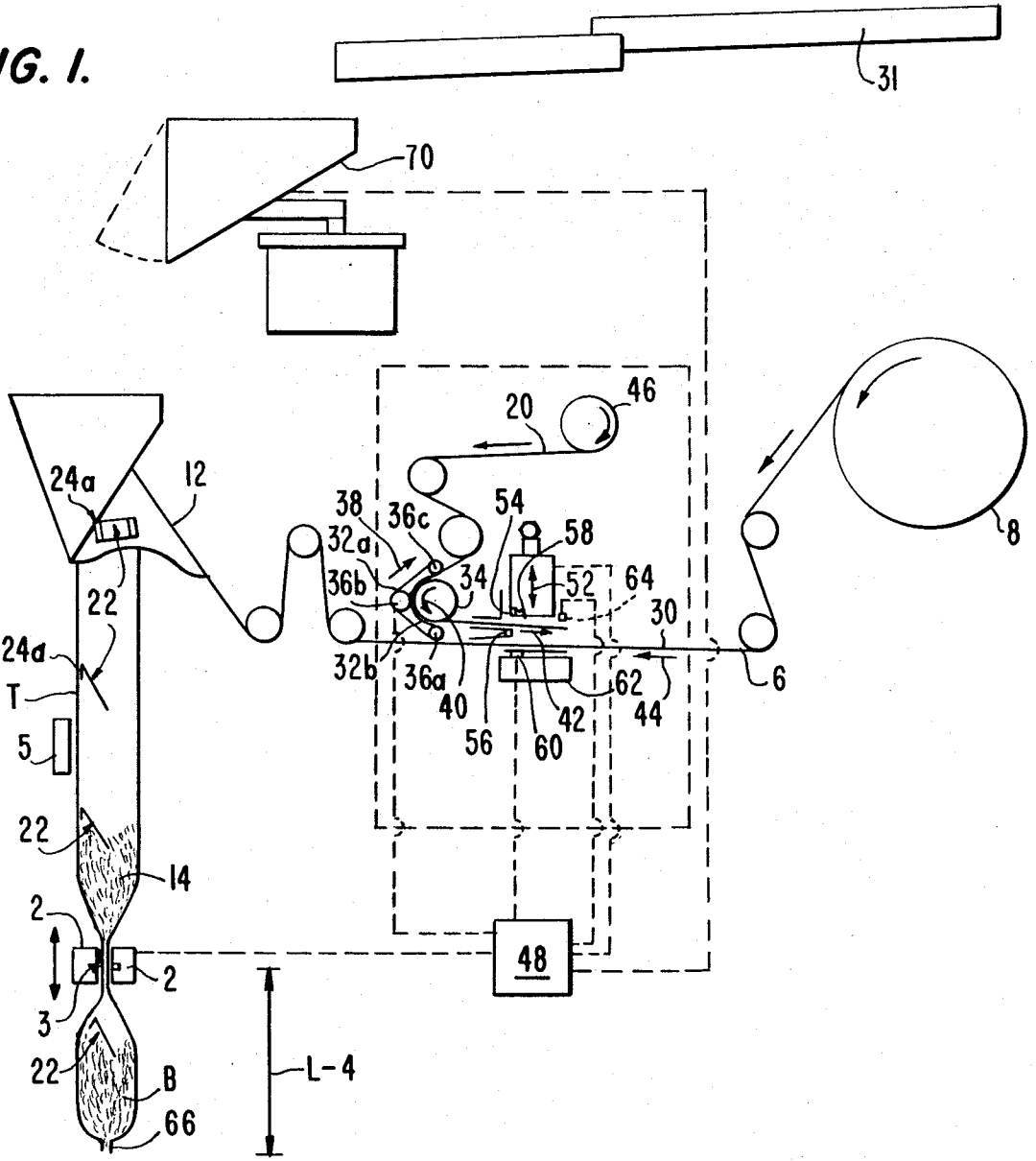
FIG. 1 is an elevational view, partly schematic of an apparatus according to one embodiment of the invention.

With reference to FIG. 1, there is shown a system for forming and sealing bags in a substantially continuous operation wherein a sealed bag B extends below end sealing jaws 2, and a closed end tube T filled with product 14 extends above jaws 2.

During the end sealing operation, knife means 3 within sealing jaws 2 severs the lower product-filled and sealed bag B, and jaws 2 separate and move upward from their position in FIG. 1 along the filled closed end tube T. The jaws 2 stop their upward movement at a selected position below longitudinal sealing heater 5 and close together thereby sealing the end of the filled tube extending below the jaws to form a filled bag.

The jaws simultaneously seal an end of the next tube and move downward to draw additional sheet material 6 over upstream tube-former 12 to bring longitudinal margins of the web 6 of bag-making film together and move the engaged margin edges of the web past the heater or back-sealer 5 to bond the longitudinal margins of the web and form a closed-end tube.

The downward movement of the jaws 2 advances the continuous web of bag-making film 6 from roll 8 in a longitudinal direction of the film and over tube former 12.

The invention will further be described in connection with application of a coupon packet to an inside surface of a bag, but it will be readily apparent that the invention is also applicable to application of other articles such as packets of premiums and/or condiments and the like to inside bag surfaces. The invention further relates to application of articles comprised of atmosphere-modifying agents to inside bag surfaces. Atmospheres-modifying agents may include desiccants, fragrance or flavor ingredients or enhancers, oxygen level reducers, oxygen gas replacers, or tamper indicators which, for example, change color when the bag is opened. Combinations of the above are also contemplated.

Figure 3:
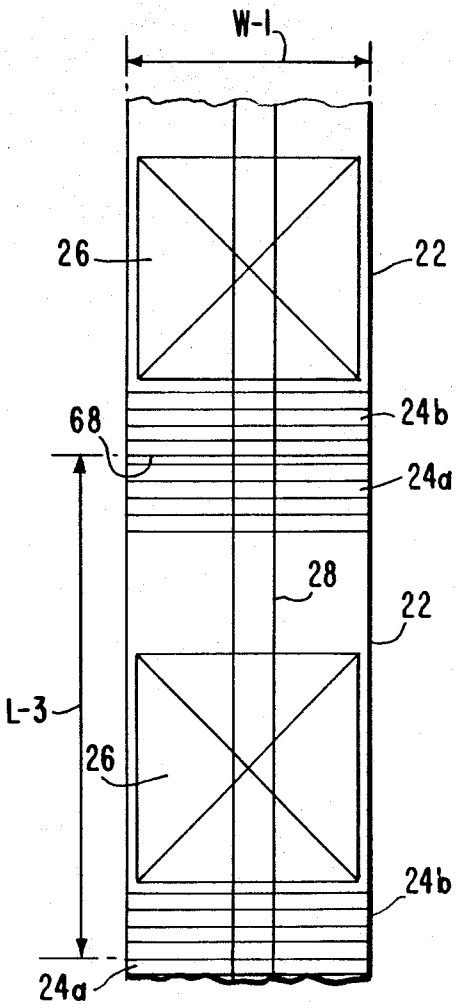
FIG. 3 is an elevational view of a continuous strip of coupon packets for application to bags according to the invention.

According to one embodiment, a continuous strip 20 of sequentially linked sealed coupon packets 22 are brought within joinable proximity of a continuous web 6 of thermoplastic polymeric bag-making film material. See FIGS. 1, 2 and 3. Joinable proximity may range from the materials contacting each other to separation of the materials by several inches or more, depending on the bonding equipment used. Each coupon packet 22 of continuous strip 20 is sequentially linked between packet strip end seals **24*a* and 24*b*. Each coupon packet 22 includes one or more coupons 26 which may be folded as shown in FIGS. 2 and 3. The strip 20 of coupon packets 22 can be formed from conventional thermoplastic bag-making material, and in the embodiments shown in the drawing are in the form small sealed bags which are similar in construction to a larger snack food bag B to which the coupon packets 22 are attached. Thus each coupon packet 22 includes a longitudinal seal 28 which runs continuously along the packet strip 20, the individual packets being defined by end seals 24*a* and 24*b*** as indicated above.

The strip 20 of coupon packets has a width dimension W-1 which is less than one-half of the transverse width of the bag-forming web 6, i.e, less than the width W-2 of a sealed bag B after bag formation. See FIG. 5. Preferably, strip 20 is sized less than one-quarter the transverse width of the web. Each coupon packet 22 further has a length dimension L-3 which is less than one-half the length dimension L-4 but advantageously no longer than the diameter of the formed bag tube. See FIGS. 3 and 5.

Coupon packet strip 20 is conveyed in an opted, but not restricted to, plane generally perpendicular to a top (inside) surface 30 of web 6 and approximately parallel with the longitudinal direction of web 6 by means which may include endless belts **32*a* and 32*b*. In the embodiment shown, endless belts 32*a* and 32*b* are biased against roller 34 with the coupon packet strip 20 therebetween. Upper endless belt 32*a* and lower endless belt 32*b* pass side-by-side around roller 36*b* in the direction shown by arrow 38, with upper belt 32*a* also passing around roller 36*c*, and lower belt 32*b* passing around roller 36*a*. Pressure applied to coupon packet strip 20 by endless belts 32*a* and 32*b* against rubbercovered roller 34 brings coupons into intimate contact with the feed/-drive roller 34 which is incrementally advanced by motor drive (not shown) in the direction indicated by arrow 40 and the coupon strip 20 to be conveyed in the direction of arrow 42, which direction 42 is generally opposite to the direction 44 of bag-forming web 6. Preferably, coupon packet strip 20 is positioned approximately 1½ inch from and parallel to the edge margins of web 6** but not in the designated longitudinal tube-seal area.

The advancement of coupon strip 20 from roll 46 is synchronized to the step-wise advancement of bag-forming material 6 from roll 8 under the control of bag endsealing jaws 2. Advancement of strip 20 and web 6 can be synchronized by any suitable means, such as by a mechanical pulley linkage (not shown) or preferably by electronic synchronization of a drive motor (not shown) connected to roller 34 and energized through control means 48.

A single coupon packet is severed from strip 20 and bonded by suitable bonding means (e.g., by heat sealing, ultrasonic sealing or cohesive sealing) to web 6 by action of air cylinder 50 after incremental movement of web 6 has been completed by the base package maker to bring the coupon packet into joinable proximity with the web. According to one embodiment, the coupon packet is severed and held by suction against a pivoting transfer device (not shown) which then pivots towards the web and applies to coupon against the web for bonding by the bonding means. With coupon transfer device conveying the coupon packet between the coupon severing means and the web, joinable proximity can be up to six inches, or greater. The coupon packet may be bonded to web 6 along only one edge portion as shown, or alternatively along a plurality of edges of the packet or elsewhere along the packet.

Referring to FIG. 3, a coupon packet 22 is severed from packet strip 20 along line 68 between sealed end portions **24*a* and 24*b* of adjacent coupon packets, the coupon packets remaining sealed after severance of a coupon packet from strip 20**.

During a single coupon cutting and bonding operation, air cylinder 50 reciprocates in the directions shown by double-ended arrow 52. Attached to air cylinder 50 is a knife edge 54 which cooperates with a corresponding knife edge 56 to sever a single packet 22 from coupon strip 20. After severing coupon packet 22 from coupon strip 20, air cylinder 50 continues its movement in the direction of bag-forming web 6 while carrying the severed coupon packet. The coupon packet 22 and web 6 then are pressed between a heat-sealing bar 58 carried by air cylinder 50 and the heat-sealing anvil 60 carried on anvil support 62 to bond a transverse edge portion **24*a* of the severed coupon packet to web 6. See FIGS. 1, 2 and 5. Air cylinder 50 then retracts to the position shown in FIG. 1**.

As noted above, the coupon severing and bonding sequence is synchronized with forming and filling of a single downstream bag. Other packet severing means can be employed, such as partially rotating knife means which sever a coupon packet by rotationally bringing a knife blade into cutting contact with the packet strip. The packet bonding means can be separate from the packet severing means, and may comprise, for example, separately rotating bonder bar and anvil which seal the packet to the web upon rotational alignment of the bonder bar and anvil.

During synchronous operation, downward movement of bag end-sealing jaws 2 advances the bag-forming web 6 from roll 8 and over former 12. Simultaneously with the downward movement of bag end-sealing jaws 2, belt portions 32*a* and 32*b* move and roller 34 rotates to advance packet strip 20 to the position shown in FIG. 1 under the control of sequencer 48. Advancement of packet strip 20 is terminated when sensor 64 senses a printed registration mark (not shown) incorporated in the packet strip that packet strip 20 has advanced a distance corresponding to the length dimension L-3 of one coupon packet. Product bag end seals 66 are also formed during downward movement of jaws 2, and tube T is filled with product from product-weighing apparatus 70 which receives product by way of conveyor 31.

Upon termination of downward movement of jaws 2 and severing of the lower product-filled and -sealed bag B, bag end-sealing jaws 2 separate and move upward from their position in FIG. 1 along the filled closed end tube T. During upward movement of jaws 2, sequencer 48 signals air cylinder 50 to move in a downward direction thereby severing a single coupon packet from strip 20 and heat sealing a transverse edge portion of the packet to the top (inside) surface 30 of bag-forming web 6. It is thus apparent that advancement of coupon strip 20 as well as severing and bonding of a coupon packet 22 to bag-forming web 6 takes place during the forming and filling of a single bag.

During the form-and-fill operation, a portion of the tube T corresponding to an end of a bag B is gripped and sealed by jaws 2 to form a closed end tube. The jaws 2 move downward pulling the closed end tube past longitudinal sealing heater 5 which seals the engaged edges of the tube by applying heat and pressure to the edges and any adhesive therebetween to form a back seal along the closed-end tube. The closed-end tube is filled with product 14 from the product-weighing device 70 during back seal formation or immediately thereafter. Subsequent to severing of a bag with knife 3, jaws 2 release the sealed end of the bag B and move upward along the length of the closed end tube a distance equal to bag length plus a given product stripping length. The jaws having reached the top of the cycle may partially close together for a stripping distance before reaching a point corresponding to the opposite end of a product-filled bag and final jaw close to seal the end of the tube containing product to form the filled bag. The jaws simultaneously seal the end of the next tube and then move downward to effect back seal formation by heater 5 of the newly formed closed end tube. The formed bag is separated from the continuous material by knife 3 when the jaws have pulled the film a distance corresponding to the length of the bags being formed, which may be coded for by a printed eye-mark (not shown) on the film web 6. Bag end seals 66 define top and bottom portions of a sealed bag B. The bag end-sealing jaws 2 simultaneously form top and bottom end seals in adjacent bags, the bag end-sealing jaws and the bag-severing knife 3 operating sequentially during formation of a single bag.

Figure 6:
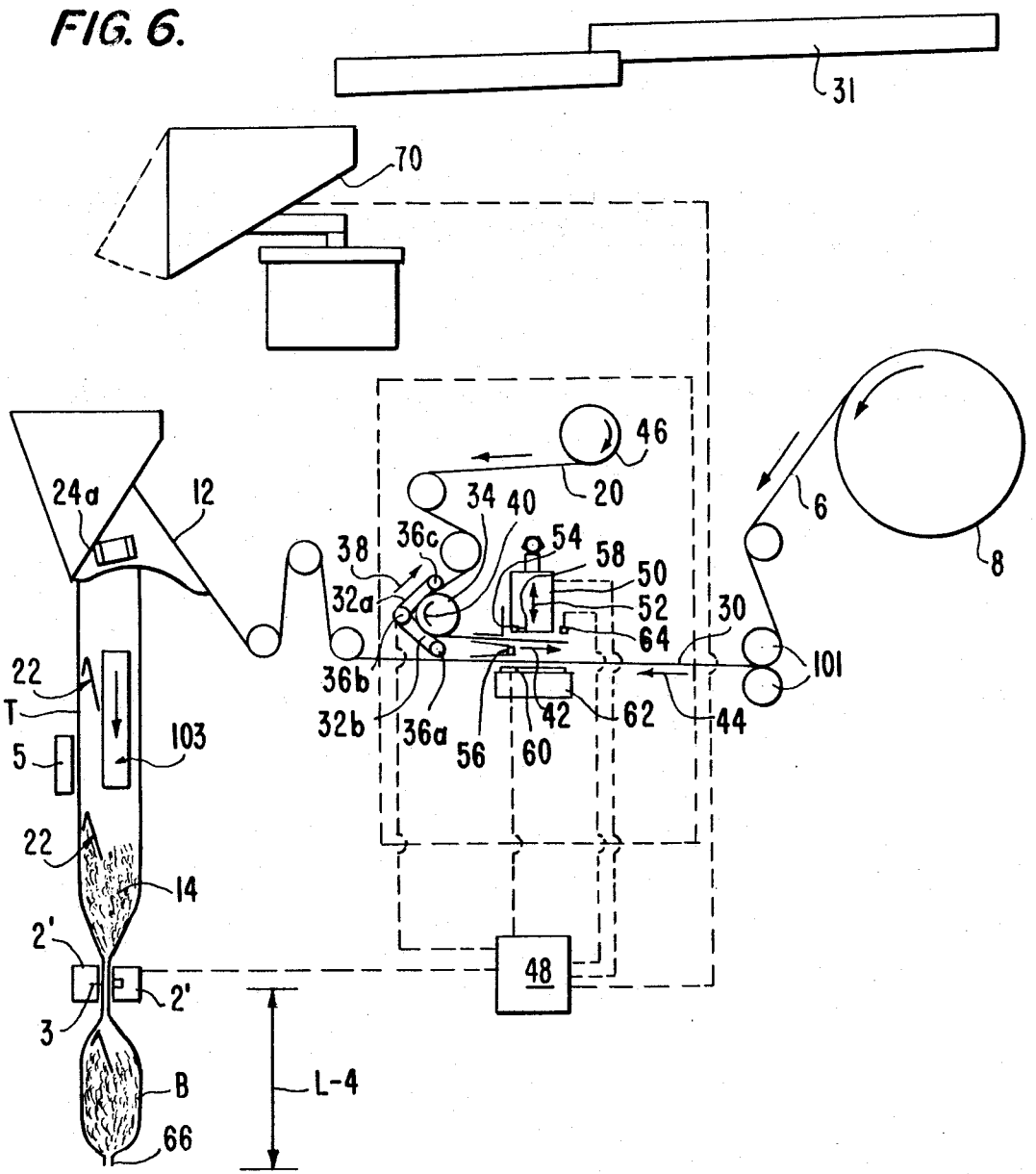
FIG. 6 is an elevational view, partly schematic, of an apparatus according to a third embodiment of the invention.

FIG. 6 illustrates application of the invention using intermittent packagers whereby the film is advanced by a pair of nip-type metering rolls 101 with assist by external film pull belts 103 (one shown in FIG. 6) against the product fill tube. Such packagers are sold by Hayssen Manufacturing Co. under the tradename "Ultima." In this arrangement, the end seal jaws 2' are in a fixed position relative to the tube former and have only a horizontal in/out motion for forming seals. Sequences for forming and filling are similar to those described above with reference to FIG. 1, but are programmed or encoded for microprocessor or controller input within a bag-making/fill cycle. Application of a coupon or premium remains essentially the same as described with reference to FIG. 1, and parts having substantially the same function as in FIG. 1 are given the same reference numerals.

Figure 4:
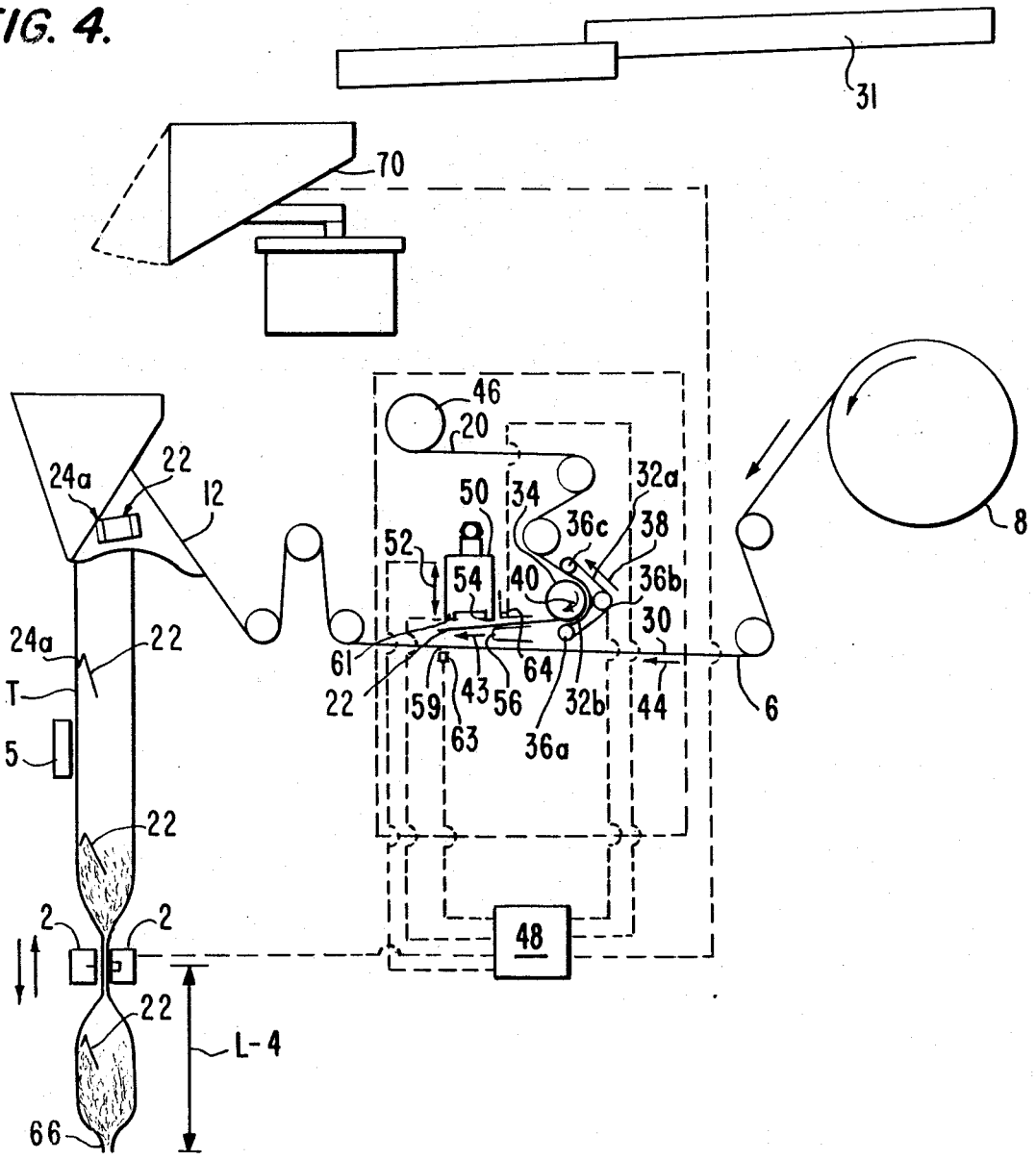
FIG. 4 is an elevational view, partly schematic, of an apparatus according to a second embodiment of the invention.

With reference to yet another embodiment shown in FIG. 4, parts having substantially the same function as in FIG. 1 are given the same reference numerals. According to this embodiment, coupon packet strip 20 is conveyed in generally the same direction as web 6 immediately prior to severing a separate coupon packet from the strip.

Coupon packet strip 20 is conveyed in an opted but not restricted to plane perpendicular to a top (inside) surface 30 of web 6 and parallel with the longitudinal direction of web 6 by means which include endless belt portions 32*a* and 32*b*. Belt portion 32*b* is biased against roller 34 with the coupon packet strip 20 therebetween. Endless belt portions 32*a* and 32*b* pass around rollers 36*a*, 36*b* and 36*c* in the direction shown by arrow 38. Pressure applied to coupon packet strip 20 by endless belts 32*a* and 32*b* to rubber-covered roller 34 brings coupons into intimate contact with feed/drive roller 34 which is incrementally turned or indexed by stroke of an air cylinder in the direction indicated by arrow 40 and the coupon strip 20 to be conveyed in the direction of arrow 43, which direction 43 is the same as direction 44 of bag-forming web 6. Preferably, coupon packet strip 20 is positioned approximately 1½ inches from and parallel to the edge margins of web 6 but not in the designated longitudinal tube-seal area.

The advancement of coupon strip 20 from roll 46 is synchronized to the step-wise advancement of bag-forming material 6 from roll 8 under the control of bag end-sealing jaws 2. Advancement of strip 20 and web 6 can be synchronized by any suitable means, such as by a mechanical pulley linkage (not shown) or preferably by electronic synchronization control means 48.

A single coupon packet is severed from strip 20 and bonded (e.g., by heat sealing) to web 6 by action of air cylinder 50.

During a single coupon cutting and bonding operation, air cylinder 50 reciprocates in the directions shown by double-ended arrow 52. Attached to air cylinder 50 is a knife edge 54 which cooperates with a corresponding knife edge 56 to sever a single packet 22 from coupon strip 20. After severing coupon packet 22 from coupon strip 20, air cylinder 50 continues its movement in the direction of bag-forming web 6 while carrying the severed coupon packet. The coupon packet 22 and web 6 then are pressed between a heat-sealing bar 61 carried by air cylinder 50 and an anvil bar 59 carried on support 63 to bond a transverse edge portion 24*a* of the severed coupon packet to web 6. See FIGS. 2, 4 and 5. Air cylinder 50 then retracts to the position shown in FIG. 4.

As noted above, the coupon severing and bonding sequence is synchronized with forming and filling of a single downstream bag.

During synchronous operation, downward movement of bag end-sealing jaws 2 advances the bag-forming web 6 from roll 8 and over former 12. Simultaneously with the downward movement of bag end-sealing jaws 2, belt portions 32*a* and 32*b* move, and roller 34 rotates to advance packet strip 20 to the position shown in FIG. 4 under the control of sequencer 48. Advancement of packet strip 20 is terminated when sensor 64 senses a printed registration mark (not shown) incorporated in the packet strip that packet strip 20 has advanced a distance corresponding to the length dimension L-3 of one coupon packet. Adjustments in position of the heat-seal bar 61 and the anvil bar 59 must be made consistent with increase or decrease in coupon packet length L-3. Product bag end seals 66 are also formed during downward movement of jaws 2, and tube T is filled with product from product-weighing apparatus 70 which receives product by way of conveyor 31.

Upon termination of downward movement of jaws 2 and severing of the lower product-filled and -sealed bag B, bag end-sealing jaws 2 separate and move upward from their position in FIG. 4 along the filled closed end tube T. During upward movement of jaws 2, sequencer 48 signals air cylinder 50 to move in a downward direction thereby severing a single coupon packet from strip 20 and heat sealing a transverse edge portion of the packet to the top 30 of bag-forming web 6. This embodiment also provides for advancement of coupon strip 20 as well as severing and bonding of a coupon packet 22 to bag-forming web 6 during the forming and filling of a single bag.

Figure 7:
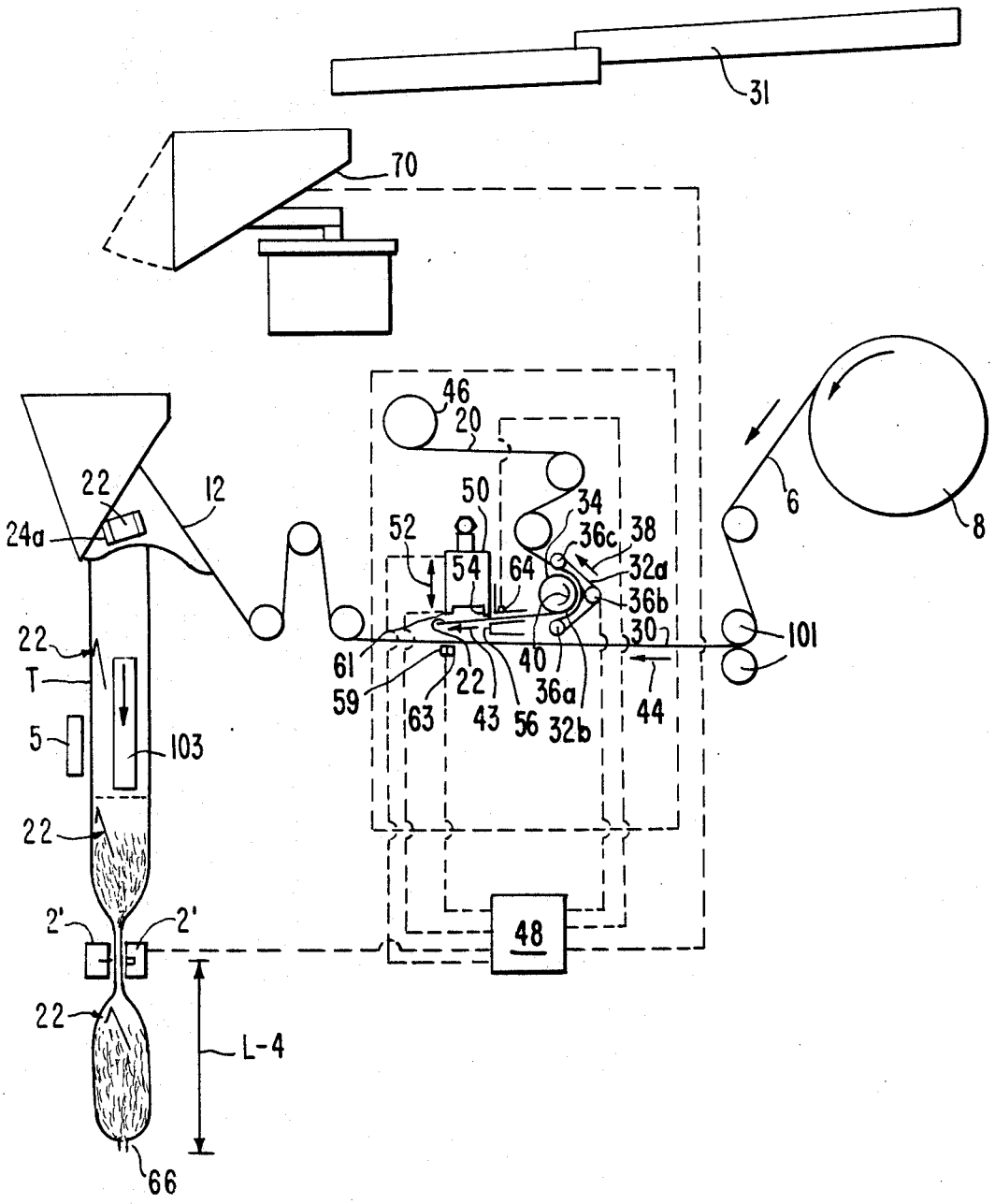
FIG. 7 is an elevational view, partly schematic, of an apparatus according to a fourth embodiment of the invention.

FIG. 7 illustrates application of this embodiment using intermittent packagers whereby the film is advanced by a pair of nip-type metering rolls 101 with assist by external film pull belts 103 (one shown in FIG. 7) against the product fill tube. As noted above, such packagers are sold by Hayssen Manufacturing Co. under the tradename "Ultima." As described above, the end seal jaws 2' are in a fixed position relative to the tube former and have only a horizontal in/out motion for forming seals. Sequences for forming and filling are similar to those described above with reference to FIGS. 4 and 6, but are programmed or encoded for microprocessor or controller input within a bag-making/-fill cycle. Application of a coupon or premium remains essentially the same as described with reference to FIGS. 4 and 6, and parts having substantially the same function as in FIGS. 4 and 6 are given the same reference numerals.

Figure 8:
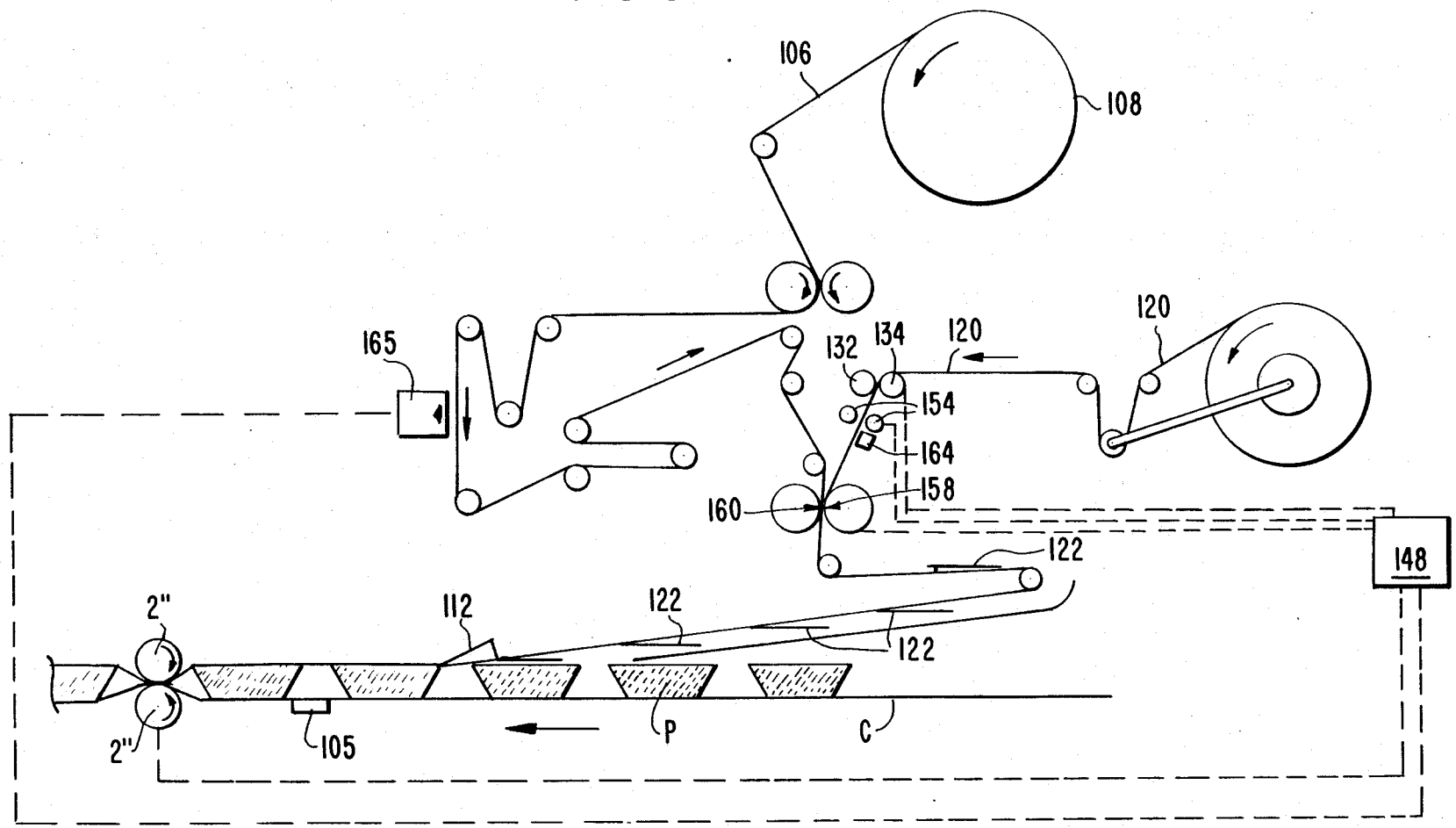
FIG. 8 is an elevational view, partly schematic, of the invention with continuous motion horizontal packaging.

FIG. 8 illustrates an embodiment of the invention with packet application during continuous-motion bag formation around horizontally advancing product P on a conveyor belt C. In this embodiment, the bag-forming web 106 is continuously advanced from a roll 108 and over former 112, with advancement of a continuous packet strip 120 through rollers 132 and 134 to the position shown in FIG. 8 under the control of sequencer 148. Bag end seals are formed by rotating end sealing jaws 2" with the tube of bag-making materials surrounding product P, product P being introduced into former 112 and the formed tube by conveyor belt C. During the forming operation, the margins of the web are joined during formation of a longitudinal seal by operation of rotating film back-seal rolls 105.

Advancement of coupon strip 120 as well as severing and bonding of a coupon packet 122 to bagforming web 106 takes place during continuous formation of bags around product P.

Sensor 164 senses a printed registration mark (not shown) incorporated in the packet strip, indicating packet strip 120 has advanced a distance corresponding to the length dimension L-3 of one coupon packet. Sensor 165 senses a bag-length indicator mark (not shown) incorporated in the bag-making web, indicating that web 106 has advanced a distance corresponding to the length dimension L-4 of one bag.

Sequencer 148 synchronizes advancement of web 106 and packet strip 120, sealing by rotating seal jaws 2", severing of a coupon packet by partially rotating knife members 154, and bonding of the severed coupon packet to the web by bonding bar 158 brought into rotational alignment with anvil 160. This embodiment provides for application of an article to the inside surface of bags continuously formed over horizontally advancing product.

It is readily apparent that the present invention can be applied in a variety of vertical, horizontal or otherwise oriented bag-forming systems to apply an article to the inside of a bag.

Figure 5:
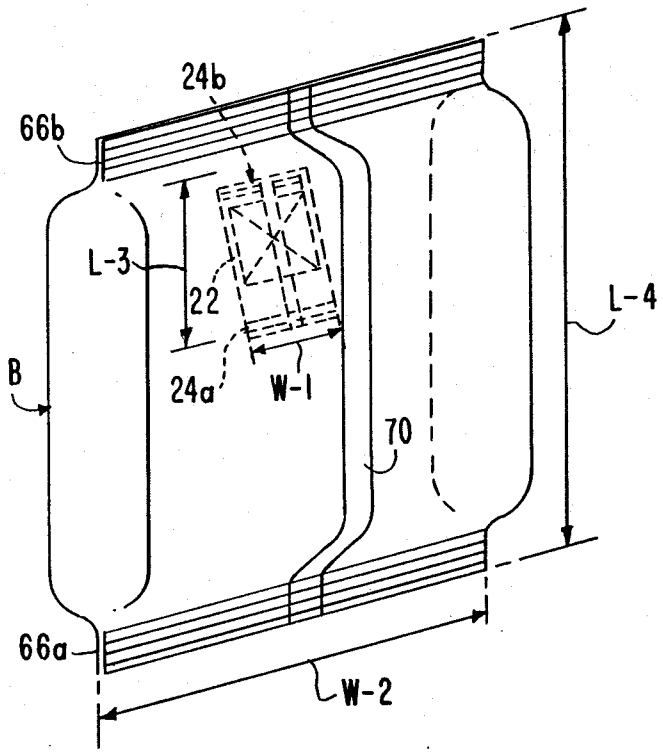
FIG. 5 is a perspective view of a sealed bag produced according to the invention having a coupon packet applied to the inside thereof.

FIG. 5 illustrates an assembled and sealed package (without product) according to this invention. The package includes top and bottom end seals 66 formed by end-sealing jaws 2, and longitudinal bag seal 70 formed by longitudinal sealing heater 5. Only one edge portion 24*a* of coupon packet 22 is bonded to an inner surface of the bag generally parallel to the longitudinal seam or seal 70. Bonded edge portion 24*a* extends transversely across the bag, i.e., generally parallel with end seals 66. Bag B has top and bottom portions 66*a* and 66*b*, respectively, which correspond to top and bottom portions 24*a* and 24*b*, respectively, of coupon packet 22, only the bottom portion 24*a* of the coupon packet being bonded to the inner surface of bag B. Synchronization of the bagforming and packet-applying operations, in combination with proper spacing of the packet-applying device with respect to the top and bottom end seals of the bag, results in the top and bottom end seals of the bag being spaced away from the packet 22 bonded to web 6 during formation of the bag.

As can be seen in FIG. 5, the top edge portion 24*b* corresponding to the top bag seal 66*b* is free and not bonded to the interior of the bag. This arrangement allows the packet to be pivoted towards the center of the bag at bonded edge portion 24*a* of packet 22 and flipped over by falling product when the bag is filled. See FIGS. 1 and 4. The coupon packet 22 is thus positioned within the product and secured to one side of the bag in a convenient and readily apparent position for the consumer after the bag is opened. Furthermore, the bag must be opened in order to achieve access to the packet.

Since many modifications, variations and changes in detail may be made to the described embodiment, it is intended that all matter in the foregoing description and shown in the accompanying drawings be interpreted as illustrative and not in a limiting sense.

What is claimed is:

1. A method for producing a bag having a length dimension between bag end seals and a width dimension, the bag having an article applied to an inside surface of the bag, said bag and said article having corresponding top and bottom portions, the method comprising:

(a) conveying a continuous web of bag-making film in a longitudinal direction thereof;

(b) providing a continuous strip of material in joinable proximity with the web, the strip having a width less than one-half of a transverse width of the web;

(c) severing the strip of material to form said article having top and bottom portions, the article having a length dimension less than the length between the end seals of said bag;

(d) bonding one edge portion only of the severed article to said continuous web of bag film, said one edge portion extending transversely of said web, said one edge portion being at the bottom portion of the article allowing the article to pivot at said bottom portion to permit the top portion of the article to flip over;

(e) bringing longitudinal margins of the web together and bonding the longitudinal margins to form the web into a tube having an inner surface to which said article is bonded; and (f) forming said bag having top and bottom portions from said tube, including severing of said bag from said tube, with said article bonded to one inner surface of said bag along said one edge portion only of said article, the bonded edge portion of the article being spaced away from the top and bottom portions of the bag.

2. The method of claim 1 wherein said one inner surface of the bag to which said article is bonded includes a longitudinal seam formed from the bonded longitudinal margins.

3. The method of claim 1 wherein said article is a packet containing a coupon, a condiment, an atmospheremodifying agent, or a combination thereof.

4. The method of claim 1 wherein said articles are sealed coupon packets and said strip of material comprises sequentially linked sealed coupon packets which remain sealed after the article-severing step.

5. The method of claim 1 wherein the article is bonded to the web by heat sealing, ultrasonic sealing or cohesive sealing.

6. The method of claim 1 wherein prior to severing said strip of material to form said article, said continuous strip of material is conveyed in a plane perpendicular to a surface of said web and parallel with the longitudinal direction of the web.

7. The method of claim 6 wherein said strip of material is conveyed in generally the same direction as said web immediately prior to severing said strip to form said article.

8. The method of claim 6 wherein said strip of material is conveyed in a generally opposite direction of said web immediately prior to severing said strip to form said article.

9. The method of claim 1 including positioning the conveyed strip of material approximately between margins of the web, but not in the bonding region of the margins.

10. The method of claim 9 wherein the articlesevering and article-bonding steps are performed sequentially during a single time period, which time period is synchronized with the bag-severing step.

11. The method of claim 10 wherein said articles are sealed coupon packets and said strip of material comprises sequentially linked sealed coupon packets which remain sealed after the article-severing step.

12. The method of claim 10 wherein the bag-forming step includes sequentially forming a bottom bag seal, introducing product into the tube, and forming a top bag seal to seal the product in the bag prior to severing the bag from the tube.

13. The method of claim 12 wherein said articles are sealed coupon packets and said strip of material comprises sequentially linked sealed coupon packets which remain sealed after the article-severing step.

14. A method for bagging a snack food product and for bonding an coupon packet to an inside surface of the bag, the method comprising:

(a) conveying a continuous web of thermoplastic polymeric film in a longitudinal direction of the web;

(b) conveying a continuous strip of sequentially linked sealed coupon packets in joinable proximity with the web, the strip having a width less than one-half of a transverse width of the web, said strip being conveyed in a plane perpendicular to a surface of said web and parallel with the longitudinal direction of the web, said strip being positioned between margins of the web;

(c) severing a sealed coupon packet having top and bottom portions from said strip;

(d) bonding one edge portion only of the severed coupon packet to said continuous web, said one edge portion being at the bottom portion of the packet and transverse to said longitudinal direction of the web;

(e) bringing longitudinal margins of the web together to form the web into a tube having an inner surface to which said sealed coupon packet is bonded;

(f) bonding the longitudinal margins together to form the web tube into a closed tube having an inner surface to which said sealed coupon packet is bonded;

(g) forming a bottom bag seal transversely across the closed tube with the bonded coupon packet within the tube and spaced away from the bottom bag seal;

(h) introducing a snack food product into the closed tube with the bottom bag seal;

(i) forming a top bag seal transversely across the closed tube and spaced away from the bonded coupon packet to form a bag with the bonded coupon packet and product between the top bag seal and the bottom bag seal; and (j) severing the bag from said tube at said top bag seal to form a separated bag of snack food product with said coupon packet bonded to one inner surface of the bag including a longitudinal seam formed from the bonded longitudinal margins,wherein the one bottom edge portion only of the coupon packet which is bonded to the web corresponds to the bottom bag seal, and wherein a top edge portion of the severed coupon packet corresponding to the top bag seal is free.

15. The method of claim 14 wherein said strip is conveyed in a generally opposite direction of said web immediately prior to severing a sealed coupon packet from said strip.

16. A bag-producing apparatus comprising:

(a) a means for conveying a continuous web of bag-making film in a longitudinal direction thereof;

(b) means for conveying a continuous strip of material in joinable proximity with the web, the strip having a width less than one-quarter of a transverse width of the web;

(c) means for severing the strip of material to form an article having a length dimension and top and bottom portions;

(d) means for bonding one edge portion only of the severed article to the continuous web of bag film, said one edge portion being at the bottom portion of the article allowing the article to pivot at said bottom portion to permit the top portion of the article to flip over;

(e) means for bringing longitudinal margins of the web together;

(f) means for bonding the longitudinal margins of the web together to form the web into a closed tube having an inner surface to which said article is bonded; and (g) means for forming said tube into a bag having top and bottom portions corresponding to the top and bottom portions of the packet, with said article bonded to one inner surface of said bag along said one edge portion only of said article with the bonded edge portion of the article spaced away from the top and bottom portions of the bag, the bag having a length dimension greater than the length dimension of said article, the bag having a width dimension greater than the width of said strip, the bag-forming means including means for severing the bag from said tube.

17. The apparatus of claim 16 wherein said one inner surface of the bag to which said article is bonded includes a longitudinal seam formed from the bonded longitudinal margins.

18. The apparatus of claim 16 wherein the means for conveying said strip positions said strip between margins of said web.

19. The apparatus of claim 16 wherein said articles are sealed coupon packets and said strip of material comprises sequentially linked sealed coupon packets which remain sealed after the article is severed by the strip-severing means.

20. The apparatus of claim 16 wherein the strip-conveying means conveys said continuous strip of material in a plane generally perpendicular to a surface of said web and parallel with the longitudinal direction of the web.

21. The apparatus of claim 20 wherein the strip-conveying means conveys said strip of material in generally the same direction as said web immediately prior to the severing of the strip by the strip-severing means to form said article.

22. The apparatus of claim 20 wherein the strip-conveying means conveys said strip of material in generally an opposite direction of said web immediately prior to the severing of the strip by the strip-severing means to form said article.

23. The apparatus of claim 16 wherein the article-severing means and the article-bonding means operate sequentially during a single time period, during which time period the bag-severing means operates.

24. The apparatus of claim 23 wherein said articles are sealed coupon packets and said strip of material comprises sequentially linked sealed coupon packets which strip-severing means.

25. The apparatus of claim 23 wherein the bag-forming means includes means for forming bag end seals which bag end seals define top and bottom portions of the bag, the bag end-sealing means simultaneously forming top and bottom end seals in adjacent bags formed from said tube, wherein said bag end-sealing means and said bag-severing means operate sequentially during said single time period.

26. The apparatus of claim 25 wherein said articles are sealed coupon packets and said strip of material comprises sequentially linked sealed coupon packets which remain sealed after the article is severed by the strip-severing means.

27. The apparatus of claim 25 further including means for introducing snack food product into the closed tube during operation of the bag-forming means to form sealed bags containing snack food product and the bonded article.

28. The apparatus of claim 27 wherein said articles are sealed coupon packets and said strip of material comprises sequentially linked sealed coupon packets which remain sealed after the article is severed by the strip-severing means.

29. An apparatus for bagging snack food product and for bonding a coupon packet to an inside surface of the bag, the apparatus comprising:

(a) means for conveying a continuous web of thermoplastic polymeric film in a longitudinal direction of the web;

(b) means for conveying a continuous strip of sequentially linked sealed coupon packets in joinable proximity with the web, the strip having a width less than one-quarter of a transverse width of the web, the strip-conveying means conveying the strip in a plane perpendicular to a surface of said web and parallel with the longitudinal direction of the web, the strip-conveying means conveying the strip between margins of the web;

(c) means for severing a sealed coupon packet from the strip of material, to form a severed sealed coupon packet having a length dimension and top and bottom portions;

(d) means for bonding one edge portion only of the severed coupon packet to said continuous web, said one edge portion being transverse to said longitudinal direction of the web said one edge portion being at the bottom portion of the packet allowing the packet to pivot at said bottom portion to permit the top portion of the packet to flip over;

(e) means for bringing longitudinal margins of the web together to form the web into a tube having an inner surface to which said sealed coupon packet is bonded;

(f) means for bonding the longitudinal margins together to form the web tube into a closed tube having an inner surface to which said sealed coupon packet is bonded;

(g) means for forming said tube into a bag having top and bottom portions corresponding to the top and bottom portions of the packet, with said coupon packet bonded to one inner surface of said bag along said edge portion only of said coupon packet, the bag having a length dimension greater than the length dimension of the coupon packet, the bag having a width dimension greater than the width of said strip, the bag-forming means including:

means for forming bag end seals transversely across the tube, which bag end seals define top and bottom portions of a bag, which top and bottom bag portions are spaced away from the bonded coupon packet, forming top and bottom end seals in adjacent bags formed from said tube; said bag-forming means further including means for severing a formed bag from said tube, the bag end-sealing means and the bag-severing means operating sequentially during formation of a bag; and (h) means for introducing snack food product into the closed tube during operation of the bag-forming means to form sealed bags containing snack food product and the bonded article.

30. The apparatus of claim 29 wherein the strip-conveying means conveys the strip in generally an opposite direction of said web immediately prior to the severing of a sealed coupon packet from said strip by the strip-severing means.

* * * * *

UNITED STATES PATENT AND TRADEMARK OFFICE

CERTIFICATE OF CORRECTION

PATENT NO. : 4,726,171

DATED : FEBRUARY 23, 1988

INVENTOR(S) : WILLIAM D. KREAGER, ET AL.

It is certified that error appears in the above-identified patent and that said Letters Patent is hereby corrected as shown below:

Front Page, under OTHER PUBLICATIONS:

line 3, delete "," and begin a new line with "1984";

line 4, begin a new line with "Undated" (second occurrence);

line 5, after "MGS" insert -- brochure --;

Column 1, line 56, delete "articles" and substitute therefor -- article --;

Column 2, line 50, delete "formand-fill" and substitute therefor -- form-and-fill --;

Column 3, line 19, delete "Atmospheres" and substitute therefor -- Atmosphere --;

, line 68, delete "rubbercovered" and substitute therefor -- rubber-covered --;

Column 4, line 14, delete "endsealing" and substitute therefor -- end-sealing --;

Column 7, line 62, delete "bagforming" and substitute therefor -- bag-forming --;

Column 8, line 32, delete "bagforming" and substitute therefor -- bag-forming --;

UNITED STATES PATENT AND TRADEMARK OFFICE

CERTIFICATE OF CORRECTION

PATENT NO. : 4,726,171

DATED : FEBRUARY 23, 1988

INVENTOR(S) : WILLIAM D. KREAGER, ET AL.

It is certified that error appears in the above-identified patent and that said Letters Patent is hereby corrected as shown below:

Column 9, line 29, delete "pheremodifying" and substitute therefor -- phere-modifying --;

, line 54, delete "articlesever" and substitute therefor -- article-sever --;

Column 11, line 53, after "which" insert -- remain sealed after the article is severed by the --.

Signed and Sealed this

Sixth Day of March, 1990

*Attest:*

*Attesting Officer*

JEFFREY M. SAMUELS

*Acting Commissioner of Patents and Trademarks*